United States Patent [19]

Ferro

[11] Patent Number: 4,781,307

[45] Date of Patent: Nov. 1, 1988

[54] COMBINATION GOLF BALL AND TEE DISPENSER

[75] Inventor: Ernest Ferro, Monsey, N.Y.

[73] Assignee: Golf Cad-Eze Corporation, Central Islip, N.Y.

[21] Appl. No.: 88,017

[22] Filed: Aug. 17, 1987

Related U.S. Application Data

[63] Continuation-in-part of Ser. No. 931,140, Nov. 17, 1986, abandoned.

[51] Int. Cl.[4] ..... B65G 59/00

[52] U.S. Cl. ..... 221/131; 221/301; 221/281; 221/283

[58] Field of Search ..... 221/281, 298, 297, 299, 221/289, 301, 131, 283, 221, 223, 307, 309; 273/320, 201; 224/452, 919

[56] References Cited

U.S. PATENT DOCUMENTS

| | | | |
|---|---|---|---|
| 1,225,728 | 5/1917 | Cooley | 221/307 |
| 1,280,692 | 10/1918 | Errett | 221/307 |
| 1,496,491 | 6/1924 | Ringler | 221/307 |
| 1,728,454 | 9/1929 | Sterling | 221/297 |
| 1,778,225 | 10/1930 | Monrss | 224/919 |
| 1,810,491 | 6/1931 | McClure | 221/309 |
| 2,024,484 | 12/1935 | Smith | 224/919 |
| 3,105,611 | 10/1963 | Conti | 221/281 |
| 3,206,067 | 9/1965 | Smith et al. | 221/281 |
| 3,281,013 | 10/1966 | Motard | 221/301 |
| 3,984,029 | 10/1976 | Baugh | 221/2 |
| 4,269,338 | 5/1981 | Sichel | 221/309 |

FOREIGN PATENT DOCUMENTS

| | | | |
|---|---|---|---|
| 133365 | 2/1985 | European Pat. Off. | 273/201 |

*Primary Examiner*—H. Grant Skaggs

*Attorney, Agent, or Firm*—Erwin S. Teltscher; Alfred M. Walker

[57] ABSTRACT

A ball dispenser for dispensing balls includes a first elongated open-ended tube for stacking the balls, a finger-operable dispenser permitting positioning, touch and inspection of a lowermost ball, and release of the lowermost ball by the finger of one hand of the user, so as to leave the other hand free. The finger-operable dispenser mechanism includes a holder mounted near one end of the first tube, a two-position spring-loaded lever pivotably mounted on the holder, and having a ball support portion normally supporting the lowermost ball, a finger-operable portion connected to the ball support portion, and a transient ball resting portion opposite the ball support portion, and which protrudes into the first tube interior through a slot formed in the tube. The ball support portion is normally urged by the spring-loaded lever to abut the lowermost ball, when the spring-loaded lever is in a rest position, but permits release of the lowermost ball upon actuation of the finger-operable portion, the transient ball resting portion temporarily blocking release of a ball above the lowermost ball, when the spring-loaded lever is in an actuated position, both resumes an inoperative position when the finger-operable portion reverts to the rest position, whereby the ball previously positioned above the now released, and erstwhile lowermost ball becomes the new lowermost ball, due to the action of gravity.

5 Claims, 5 Drawing Sheets

Fig. 4
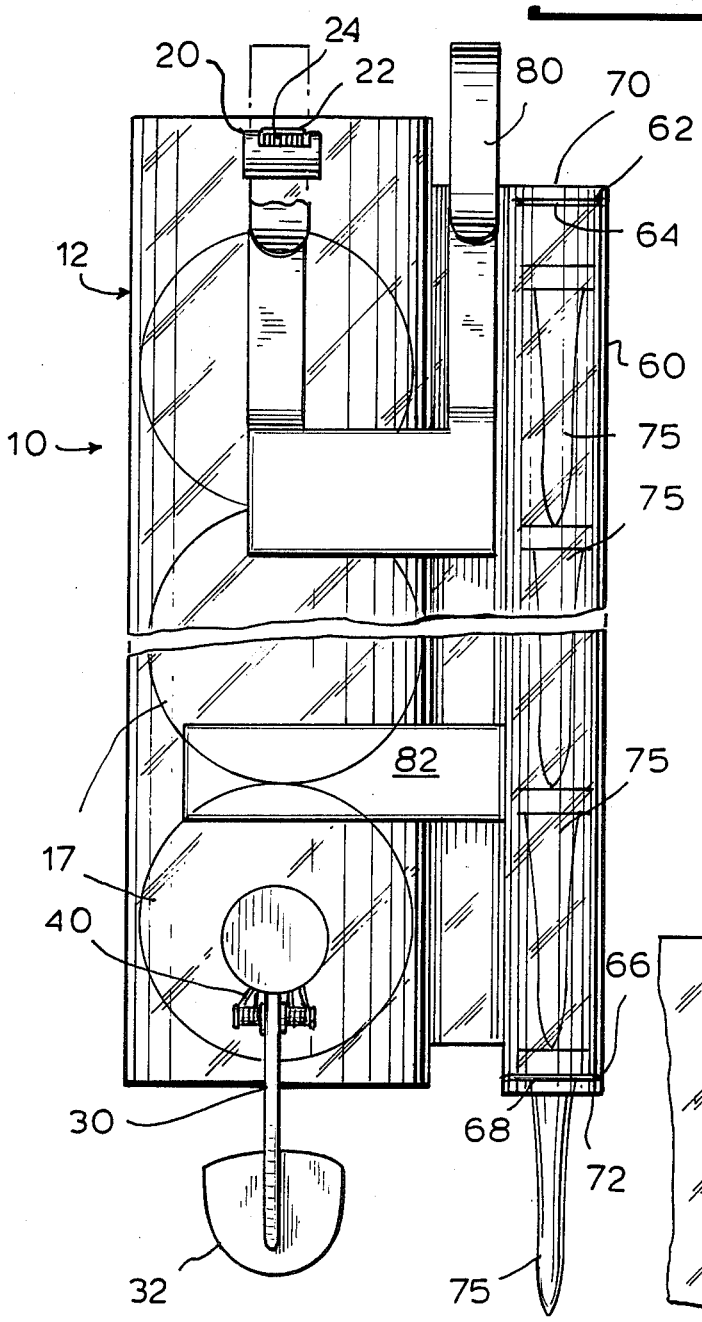
Fig. 5
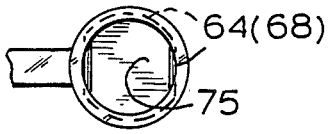
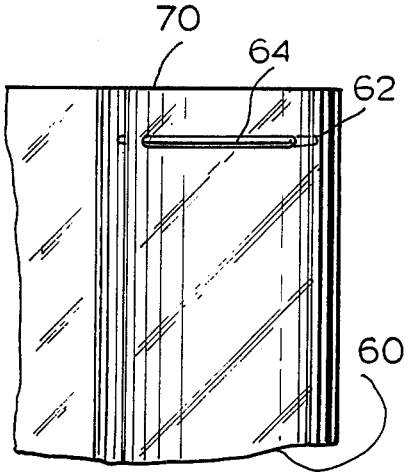
Fig. 6

Fig. 11
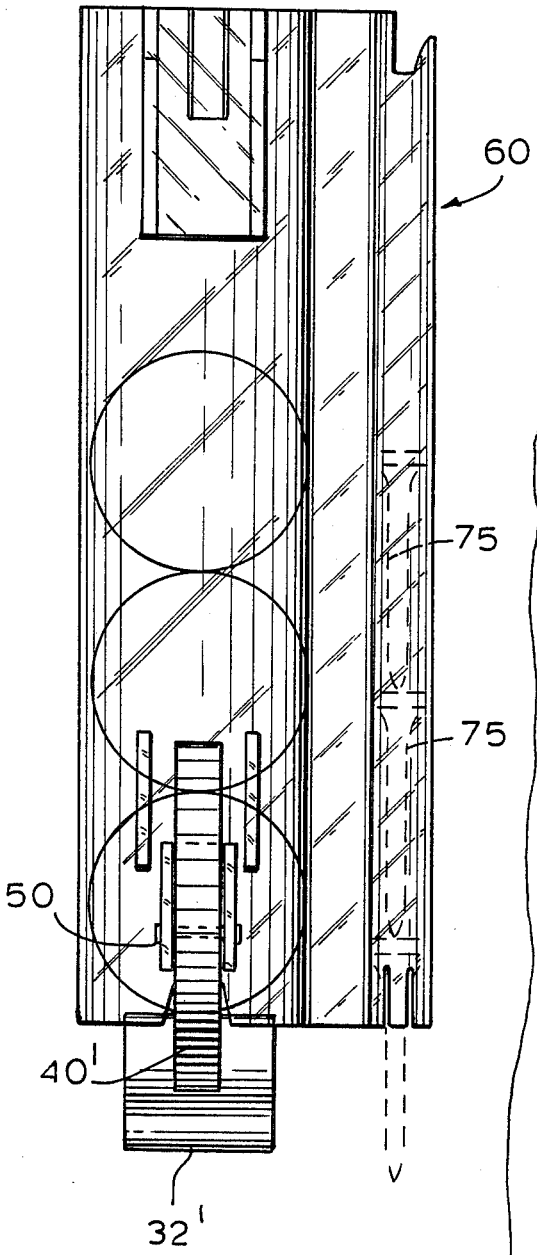
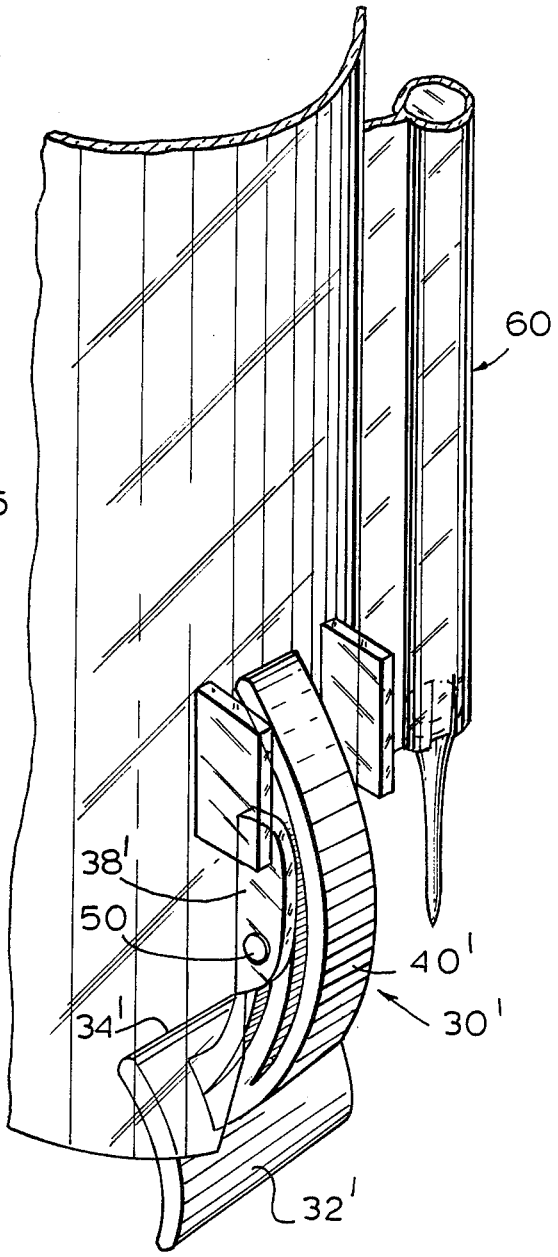
Fig. 12

COMBINATION GOLF BALL AND TEE DISPENSER

This application is a continuation-in-part of application Ser. No. 931,140, filed Nov. 17, 1986 now abandoned.

BACKGROUND OF THE INVENTION

1. Field of the Invention

The present invention relates to a golf ball and tee holder for use during a golf game and particularly suitable for a superstitious or nervous golfer to calm his or her nerves. Golf balls and tees are inserted, held and dispensed in two respective elongated open-ended tubes. A portion of the lowermost ball is exposed in the ball holding tube, thereby permitting the golfer to both touch and/or position the lowermost ball. Alternatively, the golfer may manually examine the the ball for surface imperfections by rotating the ball within the ball holding tube.

2. Description of the Prior Art

Various golf balls and tee dispensers are discussed below.

A ball holder for golf bags is disclosed in Fischer, U.S. Pat. No. 1,718,952 wherein a cylindrical ball holder is formed by a plurality of retainers. To remove or insert a ball, a retainer must be moved to one side of its normal position and the ball must then be passed between the retainers. Fischer does not provide any means for dispensing golf tees, nor the capability to position the lowermost ball.

A golf ball holder is taught in Anderson, U.S. Pat. No. 1,754,495. Anderson discloses a ball and tee holder approximating the shape of a golf stick and intended to be carried in a golf bag. The Anderson invention provides a cylindrical tube with a permanent base, and a removable top. For a golfer to gain access to additional balls or tees, the top must be removed, which exposes the balls and tees.

Wasserlein, in U.S. Pat. No. 2,073,328, discloses a golf tee magazine device. In the Wasserlein device, golf tees are stored in a cylindrical column and are removed by snapping the lowermost tee free from a pair of hooks. Wasserlein discloses no means to dispense, touch or position a lowermost golf ball held in a cylindrical elongated golf ball tube holder.

Van Rosen, in U.S. Pat. No. 2,448,130, discloses a dispenser which dispenses round objects. The Van Rosen apparatus could be adapted to dispense golf balls. Van Rosen, utilizes a rectangularly shaped housing to hold various round objects. On the bottom of the housing there is formed a slot covered by a plate. The plate can be shifted in such a manner so as to allow a round object to pass out of the slot. The plate may be shifted by a finger-operated dispenser means. However, the Van Rosen dispenser does not permit the touching or positioning of the lowermost ball. The Van Rosen dispenser does not appear adaptable for elongated conical objects, such as tees, which can not be rolled out of the dispenser's slot.

A golf ball and tee holder is taught by Houser in U.S. Pat. No. 2,768,775. The Houser holder is a cylindrical tube for housing golf balls with a permanent top. Located on the top is an elastic or leather like strap with loops to insert golf tees. The bottom of the Houser cylindrical tube is narrow, so as to prevent a golf ball from exiting therefrom. When the golfer requires a new ball, the lowermost ball is pushed upwardly, and is allowed to pass out of the cylindrical housing through an opening large enough to allow the passage of a golf ball and located on a side wall of the cylindrical housing.

A combination golf ball carrier and dispenser as taught by Smith, et al. is disclosed in U.S. Pat. No. 3,206,067. Smith et al. teaches a cylindrical tube for holding golf balls with a pair of resilient flanges inside the tube, so as to prevent balls from exiting out from the top of the tube. A second pair of resilient flanges prevent balls from exiting out of the bottom of the tube. To remove a ball, the lowermost ball must be grasped by the golfer and pulled downwardly. The golfer must exert a downward pressure sufficient to overcome the holding force the resilient flanges exert on the lowermost ball.

Motard, in U.S. Pat. No. 3,281,031, discloses another golf ball dispenser, including an elongated open-ended tube. In the Motard patent, a plurality of balls are fed into the top end of the tube. The lowermost ball abuts a gate, which in turn is connected to a dispensing handle. When the dispensing handle is actuated, the gate opens, thereby allowing the ball to fall out of the tube.

Finally, in U.S. Pat. No. 4,082,209 by Sanders, another golf ball holder is disclosed. In the Sanders patent, an elongated tube with a permanent bottom and an opening in the side wall of the tube is provided. Balls enter and exit out of this single opening. Within the opening there is disposed a mechanical restraining finger, which when depressed, allows balls to be loaded into the tube. To subsequently remove the balls, the restraining finger is activated, thereby allowing a single ball to pass out of the single opening.

There are in the prior art various golf ball or tee holders in which a plurality of balls or tees are held and are made available to the golfer during a round of golf. However, none of the prior art devices fulfills a long felt need for a golfer to both position and/or touch the lowermost ball by means of his or her thumb or fingers, and then release the ball with that very same thumb or finger.

This long felt need is derived from the fact that many sportsmen rely on superstitious "routines" before engaging in a competitive acts of sport, in the belief that it will enhance their performance. For example, many basketball stars, such as Patrick Ewing, will bounce the basketball "7" times before a foul shot, because he realizes the number "7" has traditionally meant good luck. Or, many little leaguers will use a baseball bat autographed by a baseball superstar, such as Micky Mantle, in the hope the autographed bat will mystically enable him to hit home runs with the same proficiency, frequency and magnitude as Micky Mantle did.

So too in golf, many superstitions come into the minds of golfers. An amateur golfer may superstitiously belief that if he is able to touch or position a golf ball autographed by a great golfer, such as Arnold Palmer, before taking a crucial shot, then he too will shoot just as champion golfer Arnold Palmer does. The ability to touch or position the ball during a round a golf with the thumb or fingers of one hand, while leaving his other hand free, and then being able to release the ball with the same thumb or finger, provides the superstitious golfer with an enormous pyschological benefit by placing his or her mind at ease. Thus, it may actually also enable him to play a better round of golf.

The ability to touch and position the lowermost ball also provides a benefit for the non-superstitious golfer. It allows such a golfer to manually examine the ball for surface imperfections by rotating the lowermost ball inside the tube.

SUMMARY OF THE INVENTION

The device, according to the present invention, permits the dispensing of both golf balls and golf tees in a single device. It provides a first elongated open-ended tube for inserting, and later dispensing of golf balls, and a second elongated open-ended tube connected to the first elongated tube for inserting, stacking and later dispensing golf tees. For proper operation, the device according to the present invention, should be placed in a substantially vertical position.

Provided at the top end of the first tube is a hinge. A resilient spring connected to the hinge urges the hinge during its rest state to partially obstruct the top open end of the first tube. When the golfer inserts a ball into the open top end of the first tube, the entering ball is pushed passed the hinge, thereby compressing the resilient spring and permitting the ball to enter the first tube. Additional balls can be inserted into the first tube in an identical manner. After a ball has passed the hinge, the resilient spring urges the hinge into its rest position, thus again partially obstructing the top open end. This prevents balls already inside the first tube from exiting from the top end of the tube, thereby preventing any accidental spillage. The balls that have already entered the first tube naturally gravitate to the bottom of that first tube.

Located at the lower open end of the tube is a finger-operable dispenser. When the golfer needs a ball, the lowermost golf ball is dispensed by the golfer operating the finger-operatable dispenser. The golfer may activate the finger-operable dispenser with the thumb or any finger of one hand thereby leaving the other hand free.

This finger-operable dispenser further provides a partial exposure of the lowermost ball in the first tube. This permits any superstitious or nervous golfer to position or touch the lowermost ball prior to engaging in a golf swing. Alternatively, it permits the nervous golfer to apprehensively fondle the lowermost ball during crucial situations arising during tournament play. This provides such a golfer with a psychological advantage, as the ability to position the lowermost ball in the tube alleviates the golfer's nervous tension, or permits the golfer to position the ball in his or her own individual "good luck" position.

For the non-superstitious golfer, the ability to touch and position the lowermost ball enables the golfer to inspect that ball for any surface imperfections.

A feature provided by the instant invention is that the finger-operable dispenser activation requires only one hand. Thus, the golfer may, with his other hand, perform other tasks, such as pulling a golf club from his or her golf bag, or allowing the free hand to rest.

A second elongated open-ended tube defining an axis is provided to stack and dispense golf tees. A first circularly shaped tension spring having an expandable narrow inner circumference is mounted transversely to the axis defined by the second tube in a first slot located near the top end of the second tube. To insert tees into the second tube, the golfer inserts the pointed end of a conically shaped tee through the inner circumference of the first circularly shaped tension spring. With a continuous push to force the tee through the first spring, the inner circumference of the spring expands around the wide head portion of the tee, allowing the tee to pass therethrough and into the second tube. Once inside the second tube, the tee gravitates downwardly within the second tube.

Because the inner circumference of the first spring is too small to first accept the head portion of a tee, the first circularly shaped spring will prevent the tees from exiting out from the top end of the second tube, thus preventing any accidental spillage.

By repeating the above described insertion motion, the golfer may fill the second tube with tees, wherein the tees are stacked one on top of the other within the second tube.

A second circular tension spring with an expandable narrow inner circumference is mounted transversely to the axis of the second tube within a second slot located near the bottom of the second tube. The pointed portion of the lowermost tee extends through the inner circumference of the second spring and out of the second tube's lower open-end. The inner circumference of the second spring abuts the head portion of the tee, thus preventing it from exiting out of the bottom end of the second tube. When the golfer needs a tee, he pulls the tee out of the second tube. This causes the the inner circumference of the second spring to expand around the tee's head, and thus permits the tee to pass out of the second tube.

BRIEF DESCRIPTION OF THE DRAWINGS

The invention will be better understood with the aid of the drawings, in which:

FIG. 4 is a side-elevation view corresponding to FIG. 1;

FIG. 5 is a top plan view of the tee inlet portion of the tee dispenser, including a circular spring;

FIG. 6 is a large-scale view of the tee inlet portion of FIG. 5, with the circular spring removed for the sake of clarity.

FIG. 11 is a side view of the alternate embodiment; and

FIG. 12 is a fragmentary perspective view of the alternative embodiment.

DESCRIPTION OF THE PREFERRED EMBODIMENT

Figure 1:
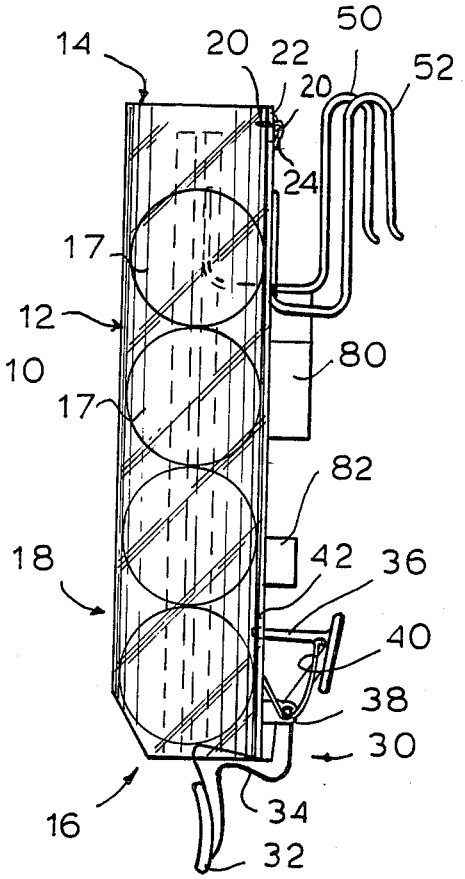
FIG. 1 is a front elevation view of a combined ball and tee dispenser, according to the present invention, with the top hinge and the finger-operable dispenser in their normal positions.

The golf ball dispenser device 10 of the present invention is intended for use during actual golf play. As shown in FIG. 1, it includes a first elongated tube 12 with a top open end 14 and a bottom open end or opening 16. The opening 16 defines a perimeter which extends in part at right angles to the direction of elongation of the tube 12 and has another part which s slanted to the direction of elongation. The inner diameter of the first tube 12 is slightly larger than that of a golf ball 17 so as to permit easy insertion and longitudinal movement of the balls 17 within the tube 12, but to prevent any transverse movements of the balls 17 within the tube 12. In a preferred embodiment, the length of tube 12 should be such as to accommodate the number of balls required to play a round of golf, for example 5–8 balls.

The method for inserting golf balls into the first tube 12 of the present invention 10 will now be described. Provided near the vicinity of upper open end 14 of tube 12 is a two-position hinge arrangement 20 hingeably attached to the tube 12, and partially protruding through a slot 22 formed in the tube 12 and into the tube's 12 interior. Hinge 20 is thus located partially outside of the tube 12 and partially within tube 12. In a first rest state position, a resilient spring 24 connected to hinge 20 urges the hinge 20 to partially obstruct the top end of the first tube, as illustrated in FIG. 1.

Figure 2:
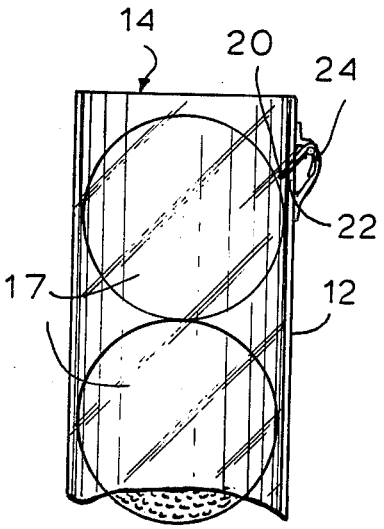
FIG. 2 is a detail of FIG. 1, with the top hinge in its downward (spring-compressed) position.
Figure 7:
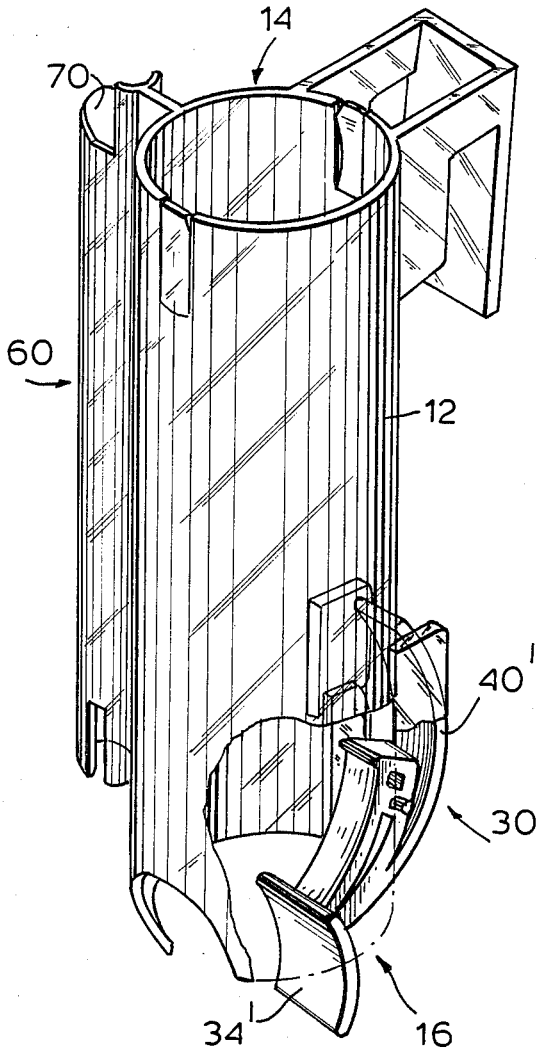
FIG. 7 is a front elevation view of an alternate embodiment of the combined ball and tee dispenser, with the dispenser in the normal position.
Figure 8:
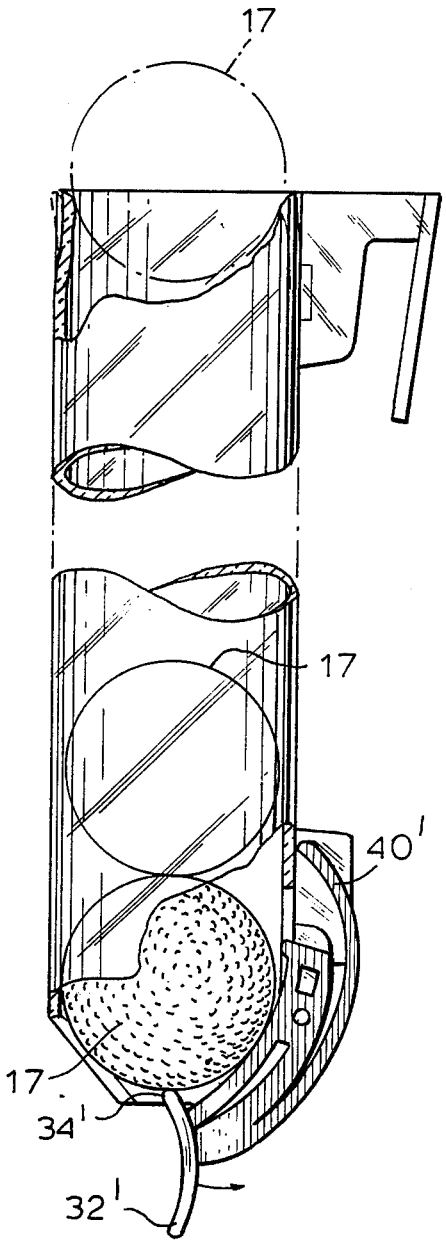
FIG. 8 is a perspective view corresponding to FIG. 7, with the tube broken away in-part, and the dispenser shown separately (not attached to the tube) for clarity.
Figure 9:
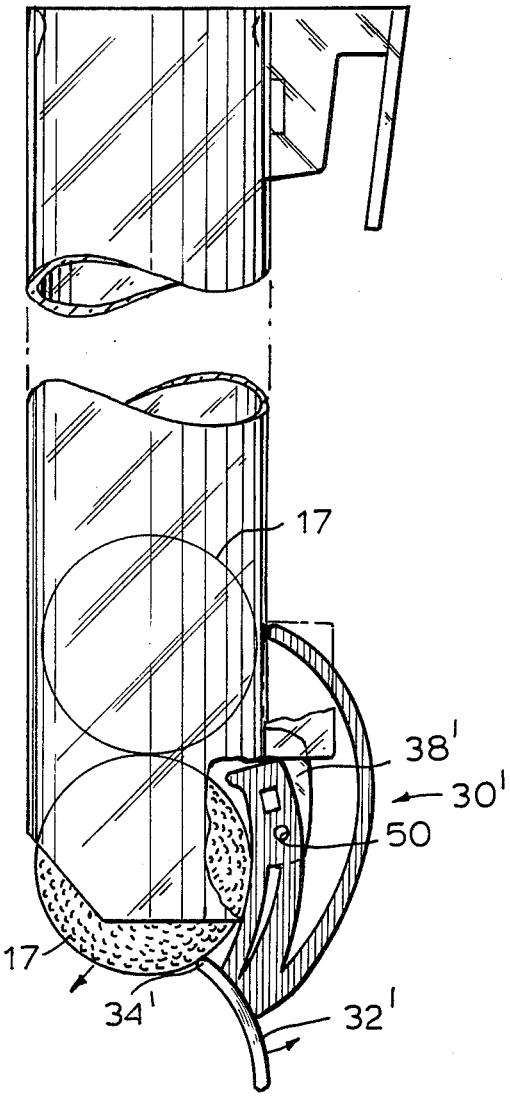
FIG. 9 corresponds to the view of FIG. 7, with the dispenser fully actuated.
Figure 10:
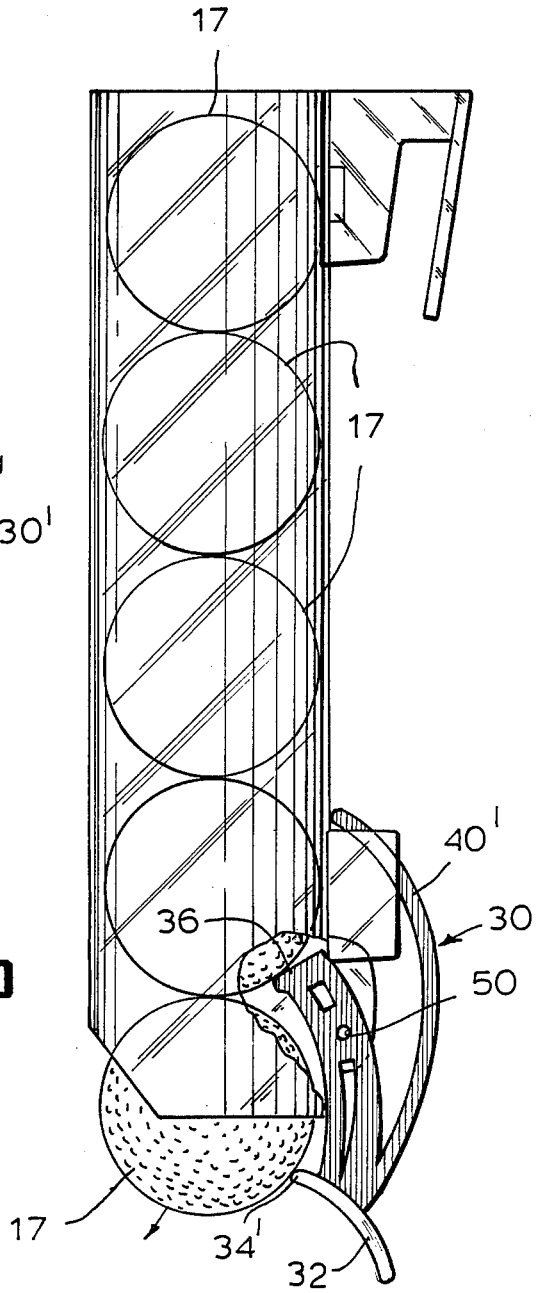
FIG. 10 corresponds to FIG. 7, with the dispenser in a half-way position between a normal and an actuated position.

To insert balls 17 into the tube 12, the golfer simply introduces a ball into top open end 14, and pushes it past the hinge 20. With sufficient pressure, the resilient spring 24 will be compressed, and hinge 20 will fold away into a second position as illustrated in FIG. 2, thereby substantially opening top end 14 and allowing balls 17 to enter the tube 12. Once inside the tube 12, the balls will gravitate downwardly towards the bottom end 16. After a ball 17 has passed the hinge 20, the resilient spring 24 will urge hinge 20 back into its normal rest position as shown in FIG. 1. This will prevent any balls previously disposed within the tube 12 from exiting from top end 14 to the tube 12, thus preventing any accidental spillage.

The operation of the ball dispenser means 30, as shown in FIG. 1, will now be described. Located at the bottom end of tube 12 is a finger- or thumb-operable dispenser 30 for dispensing the balls 17 from the tube 12. Finger dispenser 30 acts as a two position spring-loaded lever pivotally mounted on a holder 38 secured to the tube 12. The finger-operable dispenser 30 is a single rigid member having a finger-operable extension portion 32 for easy access by the golfer's fingers or thumb, a lowermost ball support portion 34, and a transient ball resting portion 36 protruding into the tube 12 through a slot 42 formed in the tube 12. Dispenser 30 has two positions: a normal resting state and a dispensing state.

Spring 40 urges dispenser 30 to assume its normal resting position as shown in FIG. 1. In such a position, the ball support portion 34 prevents balls 17 from exiting from the lower end 16 of the tube 12 by partially blocking lower end opening 16. Simultaneously, a transient ball resting portion 36 rests upon the lowermost ball 17, holding it in a substantially stable position.

Figure 3:
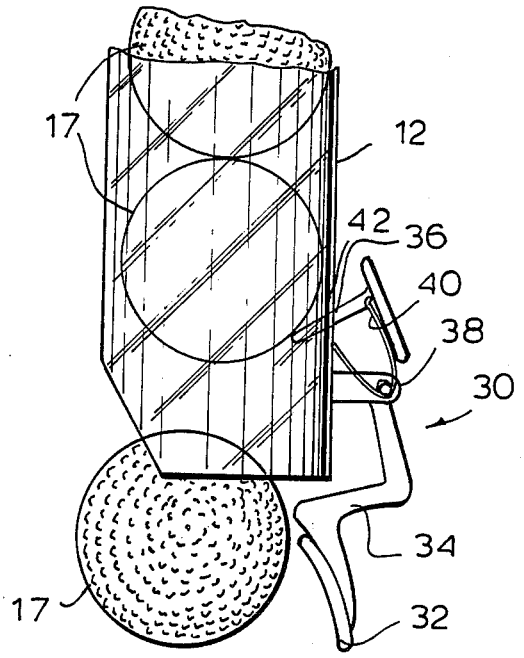
FIG. 3 is a detail of FIG. 1, with the finger-operated dispenser in the activated position.

When the golfer needs an additional ball, he pushed with his finger or thumb the finger-operable extension portion 32 of dispenser 30 into the dispensing position as shown in FIG. 3. During such a movement, the ball support portion 34 is prevented from further supporting the lowermost ball 17. Thus, the lowermost ball is now free to fall downwardly and out of the lower tube end 16. Simultaneously, the transient ball resting portion 36 protruding into tube 12 through slot 42 is shifted to temporarily abut the second lowermost ball 17. This prevents the second lowermost ball 17 from also exiting out of lower end 16 of tube 12 simultaneously with the lowermost ball 17.

After the golfer receives the erstwhile lowermost ball, now outside the tube 12, he releases the finger-operable dispenser 30. The spring 40 then urges the dispenser 30 and its ball support portion 34, finger-operable portion 32 and transient ball resting portion 36 to resume its normal vertical position. Thus, the erstwhile second-lowermost ball, due to the action of gravity falls downwardly, and becomes in turn the lowermost ball.

The device, according to the instant invention, provides partial exposure of the lowermost ball, while the finger-operated dispenser 30 is in its normal rest position. As illustrated in FIG. 1, cut away portion 18 of tube 12 permits the golfer to touch, position and inspect the lowermost ball with his or her thumb or finger, and also permits the golfer to release the lowermost ball 17 with the same thumb or finger, thus leaving his other hand free.

The preferred embodiment of the finger-operated dispenser 30' is shown in FIGS. 7–12. The dispenser 30' including the spring or resilient portion 40' can be molded or stamped from a single solid member as shown. The arcuate portion of the lower end of the dispenser 30' is formed to provide the lowermost ball support portion 34' and the finger-operable extension portion 32'. The transient ball resting portion 36' is formed adjacent to an axle 50 where the dispenser 30' is pivotally mounted on the holder 38' and secured to the tube 12. The transient ball resting portion has an inclined surface partially complementing a contour of the lowermost ball, is partially directed toward the opening, and protrudes with an extremity thereof into the interior of the tube 12.

Spring or resilient portion 40' is an integral portion of dispenser 30'. Spring or resilient portion 40' is positioned with its free end resting against tube 12 so that spring or resilient portion 40' urges the dispenser 30' to assume the normal resting position. When a golfer presses extension portion 32' in order to obtain the lowermost ball, spring or resilient portion 40' is fixed which causes dispenser 30' to return to its resting position after the extension portion 32' is released by the golfer. The two-position lever is pivotally mounted at a pivot above the opening 16, while the ball support portion 34 is located below the pivot.

Clamping hooks 50 and 52 fastened to the first tube 12 permit the ball dispenser 10 to be connected to a golf bag, golf cart or even the golfer's belt.

The ball dispenser 10 is further equipped with a second tube 60 for the holding and dispensing of golf tees 75. The structure of the tube 60 and the method for inserting golf tees 75 and later dispensing them from the tube 60 will now be described. Referral to FIGS. 5 and 6 will aid in understanding this portion of the invention.

The tee holder and dispenser 60 is a second elongated open ended tube with a top end 70 and a bottom end 72. The inner diameter of the second tube 60 is slightly larger than that of the wide head portion of a golf tee 75, so as to permit easy insertion and vertical movement of the tees 75 within the second tube 60, but so as to prevent any transverse movements within the second tube 60. In a preferred embodiment, the length of tube 60 should be long enough to accommodate the number of tees required to play a round of golf, for example 5–8 tees.

The second tube 60 defines an axis which is normally positioned to be upright. Near the top end 70 of the second tube 60 is a first slot 62 formed transverse to the axis of the tube 60. A first circularly-shaped tension spring 64 having an expandable narrow inner circumference is mounted in the first slot 62. Near the bottom end 72 of the second tube 60 there is located a second slot 66 also formed transverse to the axis of the tube 60. A second circularly-shaped tension spring 68 also having an expandable narrow inner circumference is mounted in the second slot 66. Both tension springs 64 and 68, in their rest state, have inner circumferences which are just wide enough to accent therethrough the pointed portion of a tee, but too narrow to first accept the wide head portion of a golf tee.

To insert a tee 75 into the second tube 60, the golfer must insert the pointed portion of a tee 75 through the inner circumference of the first circularly-shaped spring 64 located near the open top end 70 of the tube 60. As the golfer continues to push the tee inside the second tube 60, the inner circumference of spring 64 expands around the wide head portion of the tee 75, and thus allows the tee to pass therethrough. After the tee has completely passed spring 64 and is fully inside the tube 60, the spring 64 resumes its normal position. Thus, tees cannot exit through the top end 70 of the tube 60, thereby preventing any accidental spillage.

Once inside the tube 60, the tees 75, due to the action of gravity, move in a downwardly direction and are stacked one on top of the other inside tube 60. In a normal rest state, the pointed portion of the lowermost tee extends through the inner circumference of the second circular spring 68 located near the lower end 72 of the tube 60 and protrudes outside of the tube 60. The inner circumference of the the second spring 68 abuts the wide head portion of the lowermost tee, thereby preventing it from falling out from the lower end 72 of tube 60.

To dispense the lowermost tee, the golfer grasps the pointed portion of the lowermost tee extending outside tube 60 and pulls it downwardly. This downward force causes the inner circumference of spring 68 to expand, thereby permitting the wide head portion of the downwardly moving lowermost tee to pass through spring 68 and out of the tube 60. Due to gravity, the erstwhile next-to-the lowermost tee becomes then the lowermost tee.

As shown in FIG. 1, cross members 80 and 82 connect ball tube 12 and tee tube 60 to one another.

It is understood that although a preferred embodiment has been shown, various modifications may be made without departing from the spirit of the invention, as defined by the following claims.

I claim:

1. A ball dispenser for dispensing balls, comprising in combination a first elongated tube for stacking said balls, having a bottom opening being defined by a perimeter extending with a part thereof at right angles to the direction of elongation, and another part of said perimeter being slanted with respect to the direction of elongation, finger-operable dispenser means permitting positioning, touch and inspection of a lowermost ball, and release of said lowermost ball by the finger of one hand of the user, so as to leave the other hand free, said finger-operable dispenser means including a holder mounted near one end of said first tube, a two-position lever molded or stamped from a single solid member, being pivotably mounted at a pivot above said opening on said holder, and having a ball support portion normally supporting said lowermost ball, a finger-operable portion below said pivot and connected to said ball support portion, a transient ball resting portion having an inclined surface partially complementing a contour of the lowermost ball, being partially directed toward said opening and protruding with an extremity thereof into the first tube interior through a slot formed in said tube, and a resilient portion adjacent to, but separated by a gap from said transient ball resting portion, said ball support portion normally abutting said lowermost ball, when said lever is in a rest position, but permitting release of said lowermost ball upon actuation of said fingeroperable portion so as to flex said resilient portion, said transient ball resting portion temporarily blocking release of a ball above said lowermost ball, when said lever is in an actuated position, but resuming an inoperative position when said finger-operable portion reverts to said rest position, whereby the ball previously positioned above the now released, and erstwhile lowermost ball, due to the action of gravity, becomes the new lowermost ball.

2. The ball dispenser as claimed in claim 1, further comprising a second elongated open-ended tube defining an axis and connected to said first open-ended elongated tube for storing a plurality of conically shaped tees stacked on top of one another, said second tube being formed with first and second pairs of slots transverse to said axis near respective ends thereof, and including a first circularly shaped tension spring having an expandable narrow inner circumference, and being mounted in said first pairs of slots for passing a pointed portion of each conically shaped tee through said narrow inner circumference in one direction, said inner spring circumference expanding around a wide head portion of each conically shaped tee being passed therethrough, and resuming a normal position upon said head portion having passed therethrough, but when in said normal position preventing a movement of said wide head portion therethrough in a direction opposite to said one direction, a second circularly shaped tension spring having an expandable narrow inner circumference, being mounted in said second pairs of slots for passing the pointed portion of the tee through said narrow inner circumference, and allowing said expandable narrow inner circumference of said second spring to abut the wide head portion of a lowermost tee in a rest position of said lowermost tee, but upon an outward force being exerted on said lowermost tee, expanding and permitting said lowermost tee to be pulled out, whereby due to gravity action, an erstwhile next-to-the-lowermost tee becomes the new lowermost tee.

3. The ball dispenser as claimed in claim 2, further comprising at least one cross member connecting said first elongated open-ended tube to said second elongated open-ended tube.

4. The ball dispenser as claimed in claim 1, further comprising hinged means hinged near a top end opening of said first tube, a portion of said hinged means being located partially within said first tube's interior, and partially outside said first tube, a resilient compression spring connected to said hinged portion urging said hinged portion located within the interior of said first tube in a rest state of said hinged to assume a position so as to partially obstruct the first tube's top end opening, thereby preventing balls already disposed within said first tube from exiting in a direction out of said first tube, but upon a ball attempting to enter said first tube, the entering ball forces said hinges means partially located within said first tube's interior to assume another position compressing said resilient spring, thereby permitting the ball to enter said first tube by moving past said hinged position.

5. The ball dispenser as claimed in claim 1, further comprising at least one clamping hook secured to said first tube for connecting said first tube to a golf bag.

* * * * *